US009907343B2

(12) United States Patent
Lacey et al.

(10) Patent No.: US 9,907,343 B2
(45) Date of Patent: Mar. 6, 2018

(54) PROTECTIVE PADDING LAYER

(71) Applicants: Sam Lacey, Hampden, MD (US); Betsy Barnhardt, Baltimore, MD (US)

(72) Inventors: Sam Lacey, Hampden, MD (US); Betsy Barnhardt, Baltimore, MD (US)

(73) Assignee: WM. T. BURNETT IP, LLC, Baltimore, MD (US)

( * ) Notice: Subject to any disclaimer, the term of this patent is extended or adjusted under 35 U.S.C. 154(b) by 218 days.

(21) Appl. No.: 14/717,152

(22) Filed: May 20, 2015

(65) Prior Publication Data

US 2015/0335079 A1 Nov. 26, 2015

Related U.S. Application Data

(60) Provisional application No. 62/002,230, filed on May 23, 2014.

(51) Int. Cl.
*A41D 13/015* (2006.01)
*A63B 71/12* (2006.01)
(Continued)

(52) U.S. Cl.
CPC ..... *A41D 13/015* (2013.01); *A41D 13/0153* (2013.01); *A41D 13/0156* (2013.01); *A41D 13/0158* (2013.01); *A42B 3/124* (2013.01); *A42B 3/125* (2013.01); *A42B 3/128* (2013.01); *A63B 71/08* (2013.01); *A63B 71/10* (2013.01); *A63B 71/12* (2013.01); *A63B 2071/1258* (2013.01); *A63B 2102/14* (2015.10); *A63B 2243/007* (2013.01); *A63B 2243/0025* (2013.01); *Y10S 428/909* (2013.01); *Y10T 428/24281* (2015.01); *Y10T 428/24298* (2015.01); *Y10T 428/24314* (2015.01); *Y10T 428/24479* (2015.01); *Y10T 428/24496* (2015.01)

(58) Field of Classification Search
None
See application file for complete search history.

(56) References Cited

U.S. PATENT DOCUMENTS 55,247 A * 6/1866 Daggett ..... A43B 7/081 36/3 B
D15,185 S * 8/1884 Brooks ..... 36/32 R
(Continued)

FOREIGN PATENT DOCUMENTS

DE 2154455 A * 5/1972 ..... A47C 27/146
DE 2134049 A1 * 1/1973 ..... A47G 27/0225
(Continued)

OTHER PUBLICATIONS

Machine Translation of DE 2134049 A1, Jan. 1973 (Year: 1973).*

*Primary Examiner* — Jeffrey A Vonch
(74) *Attorney, Agent, or Firm* — Baker Donelson, PC; Royal W. Craig

(57) ABSTRACT

A flexible padding layer for use during competitive sports is provided. The flexible padding layer is comprised of a plurality of individual padding elements each joined on multiple sides with an adjacent padding element via a thin, connecting section. Each padding element further comprises openings and a three-dimensional surface configuration to allow for consistent mechanical properties throughout the padding layer as a whole.

26 Claims, 3 Drawing Sheets

(51) Int. Cl.

| | |
|---|---|
| *A42B 3/12* | (2006.01) |
| *A63B 71/08* | (2006.01) |
| *A63B 71/10* | (2006.01) |
| *A63B 102/14* | (2015.01) |

(56) References Cited

U.S. PATENT DOCUMENTS 655,576 A * 8/1900 Pearson ..... A43B 7/06 36/3 R
2,768,924 A * 10/1956 Wright ..... A47C 27/144 156/163
3,044,918 A * 7/1962 Wagner ..... B29C 44/12 156/160
3,197,357 A * 7/1965 Schulpen ..... B26D 3/281 264/160
3,386,876 A * 6/1968 Wyckoff ..... B29C 55/04 156/229
3,546,055 A * 12/1970 Spertus ..... B65D 81/03 206/523
3,616,154 A * 10/1971 Dow ..... B29C 47/12 264/154
3,945,042 A * 3/1976 Lobo ..... A41D 13/0156 2/16
4,035,536 A * 7/1977 Morrison ..... B32B 3/12 428/118
4,059,713 A * 11/1977 Mercer ..... B29C 47/0033 156/166
4,303,714 A * 12/1981 Mercer ..... B29D 28/00 264/288.8
4,590,029 A * 5/1986 Mercer ..... B29C 59/02 264/156
4,603,445 A * 8/1986 Spann ..... A47C 27/146 428/131
4,635,385 A * 1/1987 Ogden ..... A43B 17/08 36/3 B
4,686,724 A * 8/1987 Bedford ..... A61G 7/05707 5/652.1
4,713,854 A * 12/1987 Graebe ..... A47C 27/144 297/DIG. 1
4,831,749 A * 5/1989 Tsai ..... A43B 17/08 36/141
5,053,264 A * 10/1991 Beretta ..... B29C 55/04 264/DIG. 81
5,065,457 A * 11/1991 Henson ..... A63B 71/12 2/16
5,120,587 A * 6/1992 McDermott, III . A47G 27/0468 427/208.4
5,168,576 A * 12/1992 Krent ..... A41D 13/0156 2/16
5,330,165 A * 7/1994 van Goubergen ..... F16F 1/374 248/633
5,348,788 A * 9/1994 White ..... A61F 2/0077 428/131
D369,672 S * 5/1996 Tanaka ..... D2/955
5,518,802 A * 5/1996 Colvin ..... B32B 3/12 428/166
D374,367 S * 10/1996 Bonaddio ..... 5/736
5,680,657 A * 10/1997 Valtakari ..... A41D 13/0156 2/455
5,747,140 A * 5/1998 Heerklotz ..... A47C 27/144 248/630
5,891,549 A * 4/1999 Beretta ..... B29D 28/00 428/100
6,079,056 A * 6/2000 Fogelberg ..... A41D 13/0153 2/267
6,231,946 B1 * 5/2001 Brown, Jr. ..... A43B 13/026 404/134
6,654,960 B2 * 12/2003 Cho ..... A63B 71/1225 2/22
6,794,009 B1 * 9/2004 Brodeur, Jr. ..... A47G 27/0475 428/95
7,082,621 B1 * 8/2006 Fratesi ..... A41D 13/0158 2/227
D582,608 S * 12/2008 Palmer ..... D29/121.1
D606,794 S * 12/2009 Steppat ..... D6/606
D661,077 S * 6/2012 Lee ..... D2/951
8,627,512 B2 1/2014 Dodd
D701,027 S * 3/2014 Lee ..... D2/951
8,661,564 B2 3/2014 Dodd
9,067,122 B2 6/2015 Diamond
D764,779 S * 8/2016 de Montgolfier ..... D2/951
2001/0047537 A1 * 12/2001 Robertson ..... A42B 3/00 2/425
2002/0079627 A1 * 6/2002 McCollough ..... F16F 1/373 267/107
2002/0094404 A1 * 7/2002 Schottenfeld ..... B32B 5/18 428/41.8
2003/0056792 A1 * 3/2003 Bard ..... A61F 5/01 128/845
2003/0088900 A1 * 5/2003 Cho ..... A63B 71/1225 2/22
2003/0150061 A1 * 8/2003 Farley ..... A47C 27/146 5/736
2006/0005305 A1 * 1/2006 Haskell ..... A41D 13/015 2/455
2006/0205303 A1 * 9/2006 Nurnberg ..... A41D 13/05 442/123
2006/0277788 A1 * 12/2006 Fujii ..... A43B 7/08 36/3 B
2008/0060228 A1 * 3/2008 Morgan ..... A43B 1/0027 36/103
2009/0096273 A1 * 4/2009 Caruso ..... A47C 1/03 297/452.14
2009/0276933 A1 * 11/2009 Dodd ..... A41D 13/0153 2/16
2010/0024101 A1 * 2/2010 Berner, Jr. ..... A41D 13/0015 2/455
2010/0219609 A1 * 9/2010 Wootton ..... A41D 13/0002 280/304.4
2010/0295221 A1 * 11/2010 Kligerman ..... F16F 1/373 267/140.11
2011/0035864 A1 * 2/2011 Gordon ..... A41D 13/05 2/455
2011/0099696 A1 * 5/2011 Smith ..... A41D 13/0506 2/455
2011/0209275 A1 * 9/2011 Berns ..... A41D 13/0506 2/455
2013/0055596 A1 * 3/2013 Wan ..... A43B 13/141 36/25 R
2013/0232674 A1 * 9/2013 Behrend ..... A41D 13/0002 2/455
2013/0234376 A1 * 9/2013 Frey ..... A42B 3/065 267/141
2014/0259333 A1 * 9/2014 Marquez ..... A63B 71/12 2/459
2015/0101110 A1 * 4/2015 Wagner ..... A41D 13/015 2/455
2015/0196087 A1 * 7/2015 Meschter ..... A43B 13/18 36/25 R

FOREIGN PATENT DOCUMENTS

DE 19521910 C1 * 9/1996 ..... A47C 27/144
FR 2484132 A * 12/1981 ..... H01H 13/702
GB 1310373 A * 3/1973
GB 1387635 A * 3/1975

* cited by examiner

PROTECTIVE PADDING LAYER

CROSS-REFERENCE TO RELATED APPLICATION(S)

The present application derives priority from U.S. Provisional Patent Application Ser. No. 62/002,230 filed 23 May 2014.

BACKGROUND OF THE INVENTION

1. Field of the Invention

The present invention relates to wearable protective sports padding and, more particularly, to a layer of flexible and lightweight padding that, regardless of orientation, exhibits consistent material properties in all directions while improving impact protection, comfort and fit.

2. Description of the Background

Protecting players from injury is a primary concern for any sport. Sports such as hockey, football and lacrosse feature player-to-player contact as well as player-to-ground and player-to-equipment (i.e., ball, stick, puck, etc.) contact that has the potential to injure participants. Consequently, players participating in such contact sports wear protective gear such as helmets, elbow/knee pads, shin pads, rib/kidney protectors and shoulder pads. To be effective, padding must absorb and distribute the force of blows or contact, yet it cannot impede the player's range of motion, agility and speed. Toward this latter goal the padding is ideally very light-weight and flexible. Player comfort also requires that pads have adequate ventilation so that players are not overheated or overly fatigued when using their equipment during intense physical exertion.

To accomplish these opposing requirements of protection and flexibility with minimum restriction, protective gear is typically constructed of an assembly of soft padding in combination with molded, semi-rigid or hard shells or plates. These hard plates configured to be worn by the participant over those areas of the body most likely to be impacted during play of the particular game. The extent and placement of soft pads versus hard plates varies depending on where high-impact zones might occur, and these zones in turn depend on a variety of factors. For example, a lacrosse defenseman performs more stick and body checking than he absorbs and so his pads can be lighter-weight. Conversely, lacrosse attackmen require much more robust protection because their job is to avoid defensemen and score on goal, which makes them the target of much checking and physical contact. In soccer, players wear hard shell protective gear primarily on their shins, while football players wear hard shell protective gear on their shoulders and heads owing to the areas of hardest contact. A football quarterback's padding however emphasizes freedom of motion while a lineman's pads traditionally offer much more protection.

Hard shell protective gear typically comprises one or more plates of rigid plastic. While the plates can be manufactured in different sizes, they are not custom fit and are inevitably non-breathable, hard, motion-limiting and less comfortable to wear. It is more desirable that protective gear be flexible to allow maximum range of motion but also provide adequate protection to a wide range of players.

Prior art protective gear has made some strides towards pad flexibility, player comfort and range of motion. For example, U.S. Pat. Nos. 8,661,564 and 8,627,512 to Dodd describe a protective shin guard comprised of a plurality of rigid, triangular or round plates joined together by living hinges. The collective plates form a hard "core" that is disposed inside or on top of an elastomeric or conformable substrate. The plates are free to flex triaxially, each plate pivoting along an axis relative to an adjacent plate and the axes being one of three orientations. This gives the collective core some added flexibility without compromising its impact resistance. However, the three-axis flexural design of Dodd is limited by the location and direction of its hinges relative to rigid plates, thereby preventing the hard core padding from conforming maximally to the player's body and accommodating its entire range of motion. The Dodd design also is oriented toward localized impact absorption rather than widespread impact dispersion, the latter being a benefit of the material described herein.

What is needed then is a more flexible and breathable layer of hard shell padding that is sufficiently conformable to any portion of the body of a player so as to impose the least possible restriction on the player's movement. Further, what is needed is a layer of padding with these properties to also effectively disperse impact from severe blows of the type and force anticipated during high-level sports game m which a ball/puck and stick/bat are necessary implements.

SUMMARY OF THE INVENTION

Accordingly, it is an object of the invention to provide a flexible padding layer having material properties and design characteristics to better conform to the player's body, impose the least possible restriction on the player's movement, withstand blows of significant force from directions and forces anticipated during particular sports games, and increase breathability and comfort of wear.

In accordance with the foregoing objects, the present invention is a padding layer of resilient sheet material defined by a plurality of uniformly-spaced geometric perforations. Each perforation is surrounded by a marginal surface pattern of varying thickness in the sheet material to provide relatively equal multiaxial dynamic flexibility in all directions. In an embodiment, the padding layer comprises a resilient plastic sheet material defined by a plurality of hexagonal perforations through the plastic sheet material. Each hexagonal perforation may be surrounded by a marginal surface pattern of relatively thick triangular for similarly shaped) sections angularly-spaced around the perforations and having apices directed toward the perforation. Each triangular section is joined to both flanking triangular sections by a curved section of reduced thickness that facilitates flexion along its vertical axis. The resulting crown-like structure formed in the sheet material around each hexagonal perforation provides comparable flexibility in multiple directions, as well as substantially uniform tensile strength. Moreover, the hexagonal perforations provide enhanced breathability and reduced weight for the overall padding layer. These advantages are gained without compromising impact-protection, which further distinguishes Applicant's material over the prior art.

For a more complete understanding of the invention, its objects and advantages refer to the remaining specification and to the accompanying drawings.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

Figure 1:
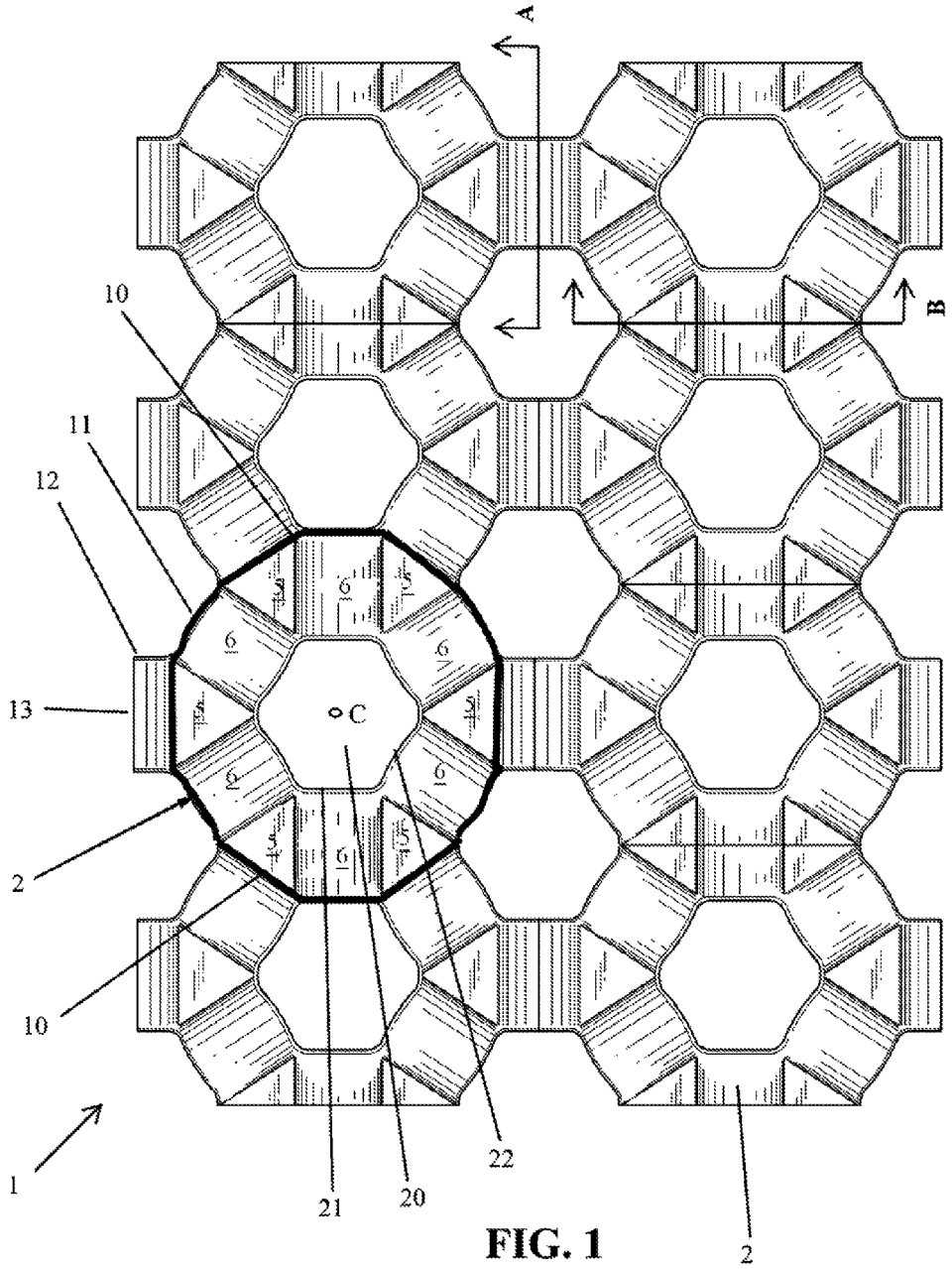
FIG. 1 illustrates an embodiment of the flexible padding layer according to the present invention from above.

With reference to FIG. 1, an embodiment of a flexible padding layer 1 according to the present invention is shown from above. As shown therein, flexible padding layer 1 is generally comprised of a resilient sheet material defined by a plurality of hexagonal perforations through the plastic sheet material.

For purposes of description, "resilient sheet material" is herein defined as any integrally-formed layer or plurality of laminate layers of flexible or semi-flexible material ranging from hard plastics (e.g., Shore D 100) to flexible or rigid foams (e.g., 10° Asker C), in all cases having a shape memory characteristic, and thickness of the crown components of the resilient sheet material (described below) varying inversely with hardness to provide a desired degree of flexibility.

In the illustrated embodiment, the padding layer 1 is patterned with a plurality of overlapping elements 2, a single one of which is outlined in bold in FIG. 1. Generally, each element 2 comprises a geometric perforation (triangular, octagonal, hexagonal, etc.) surrounded by a "crown" defined by a marginal surface pattern of varying thickness in the sheet material. This configuration offers consistent flexibility in multiple directions.

The dimensions of the flexible padding layer 1 may be varied by any number of overlapping elements 2 of uniform size, scaled as desired, and arranged in any number of columns and/or rows without departing from the scope or spirit of the invention.

In an embodiment, the flexible padding layer comprises a resilient sheet of plastic such as polyethylene defined by a plurality of uniformly-spaced hexagonal perforations 20 through the plastic sheet material. Each hexagonal perforation 20 is surrounded by a marginal surface pattern or "crown" of relatively thick angular sections 5 radially-spaced around the perforations and having apices directed toward the perforation. The angular sections 5 are preferably triangular and most preferably equilateral triangles. Each hexagonal perforation 20 and its surrounding crown of angular sections 5 define one element 2. Any number of elements 2 may be conjoined by overlapping said elements 2, sharing some common features of the crown.

When viewed from above, the crown of a single element 2 comprises a plurality of thick, flat triangular sections 5 (six being shown) uniformly spaced around the hexagonal perforation 20 with apices directed radially inward. Each triangular section 5 is joined to both flanking triangular sections 5 by a rounded shoulder 6 of decreased thickness. Shoulders 6 preferably have a hemispherical cross-section running along an axis, the axes of which are likewise radially arrayed. The thick triangular sections 5 between shoulders 6 extend from adjacent one hexagonal perforation 20 to adjacent each of its adjoining two neighbors, facilitating flexion along the vertical axes of shoulder 6. The resulting crown formed in the sheet material around each hexagonal perforation 20 provides comparable and consistent flexibility in multiple axes. Moreover, the hexagonal perforations 20 provide enhanced breathability and reduced weight for the overall padding layer 2. These advantages are gained without compromising impact-protection.

As seen in FIG. 1 each shoulder 6 is radiused lengthwise for improved tear strength while tapering to a pair of flanking edges 10. Each element 2 shares a shoulder 6 with each adjacent element 2. Thus, within each element 2, each pair of adjacent shoulders 6 diverge along their respective axes angularly from a common point proximate the center of hexagonal perforation 20, and are connected in a triangular configuration by a third shoulder 6 belonging to the next adjacent element 2, the third shoulder 6 straddling the first two and forming the base of the triangle. The entire plastic area bounded by these triangular shoulders 6 constitutes a triangular section 5.

Shoulders 6 extend axially end-to-end between adjoining hexagonal perforations 20 and terminate at opposing edges 11. When perforations 20 are hexagonal-shaped, edges 11 form an approximate 45° angle with the extended plane of edges 10. Where the flexible padding layer 1 is cut lengthwise along shoulders 6, the shoulders 6 will be sectioned leaving a plurality of protruding necks 12, one at each distal end of each element 2.

Further as shown in FIG. 1, the hexagonal perforation 20 of each element 2 is centered on the center point C and is bordered by an unbroken hexagonal ring defined by the six endmost-edges 11 of radially-converging shoulders 6. One skilled in the art will understand that the overall area of opening 20 may be dictated by design or player preference, wherein an opening having a larger surface area may provide greater breathability and lighter overall weight of flexible padding layer 1, while a more narrow opening may provide greater protection from impacts from small elements that a player may contact during game play. In the preferred embodiment shown in FIG. 1, however, the width of the hexagonal perforation 20 is approximately ⅗ the overall width of element 2, while the overall length of the hexagonal perforation 20 is approximately ⅖ of the overall length of element 2.

Figure 2:
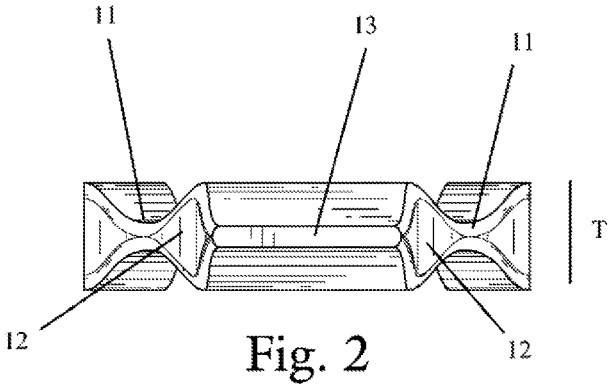
FIG. 2 illustrates a side view of the flexible padding layer according to the present invention along direction A as indicated in FIG. 1 wherein an individual unit of the flexible padding layer is depicted.
Figure 3:
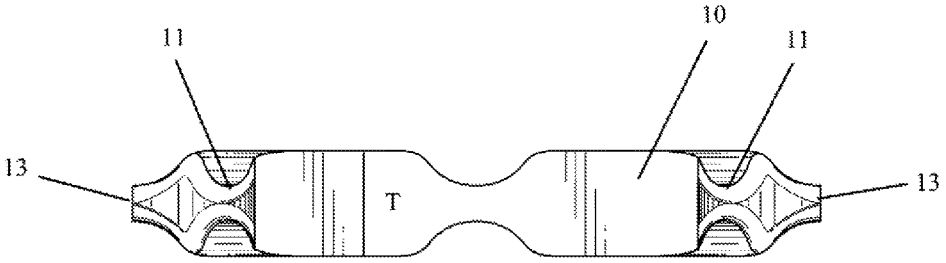
FIG. 3 illustrates a side view of the flexible padding layer according to the present invention alone direction B as indicated in FIG. 1 wherein an individual unit of the flexible padding layer is depicted.
Figure 4:
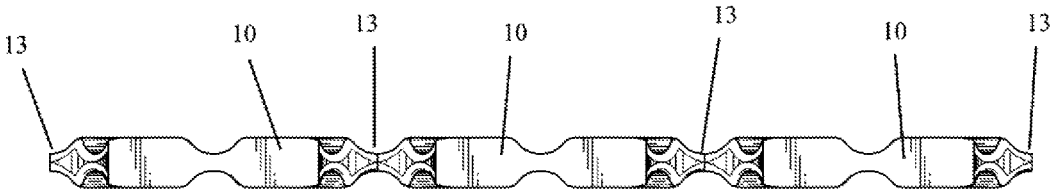
FIG. 4 illustrates a side view of the flexible padding layer according to the present invention along direction B as indicated in FIG. 1 wherein multiple individual units of the flexible padding layer are depicted.

The contour profile of the crown of elements 2 when viewed from the side are shown in FIG. 2-4, where FIG. 2 shows an end view of an element 2 in direction A as indicated in FIG. 1 and where FIG. 3 shows an end view of an element 2 in direction B as indicated in FIG. 1. With collective reference to FIGS. 1-3, it can be seen that each element 2 has a maximum thickness T. In addition, those portions of element 2 between the outer edge of element 2 and the outer edge of the hexagonal perforation 20 which abut each of the six sides 21, 22 of opening 20 and extend radially therefrom to the mirroring portion of the outer edges 10, 11 of element 2 are tapered to a reduced thickness relative to the maximum thickness T of element 2, thereby facilitating flexion along the vertical axes of the radially configured portions. Thus, when viewed, from the side along direction B, as shown in FIG. 3, it can be seen that approximately the middle third of edge 10 is depressed relative to maximum thickness T. Further as seen in FIG. 3, it can be seen that the entire triangular section 5 between shoulders 6 including the sides 22 of hexagonal aperture 20 are also depressed relative to maximum thickness T. These areas of reduced thickness decrease towards each distal end to a minimum thickness T2, where T2 is within a range of from approximately ⅕-½ the maximum thickness T of elements 2, and most preferably ⅓. By way of example, in one embodiment T can measure 2.5 mm and T2 can measure 0.7 mm.

Between areas of minimum thickness T2 and areas of maximum thickness T, the surface area of the crown of elements 2 is contoured, forming roughly an hourglass shape when viewed from the side as shown in FIG. 2. Also as can be seen, each face of element 2, upper and lower when viewed from the side as in FIGS. 2-3, forms a mirror image with the opposing face.

Figure 5:
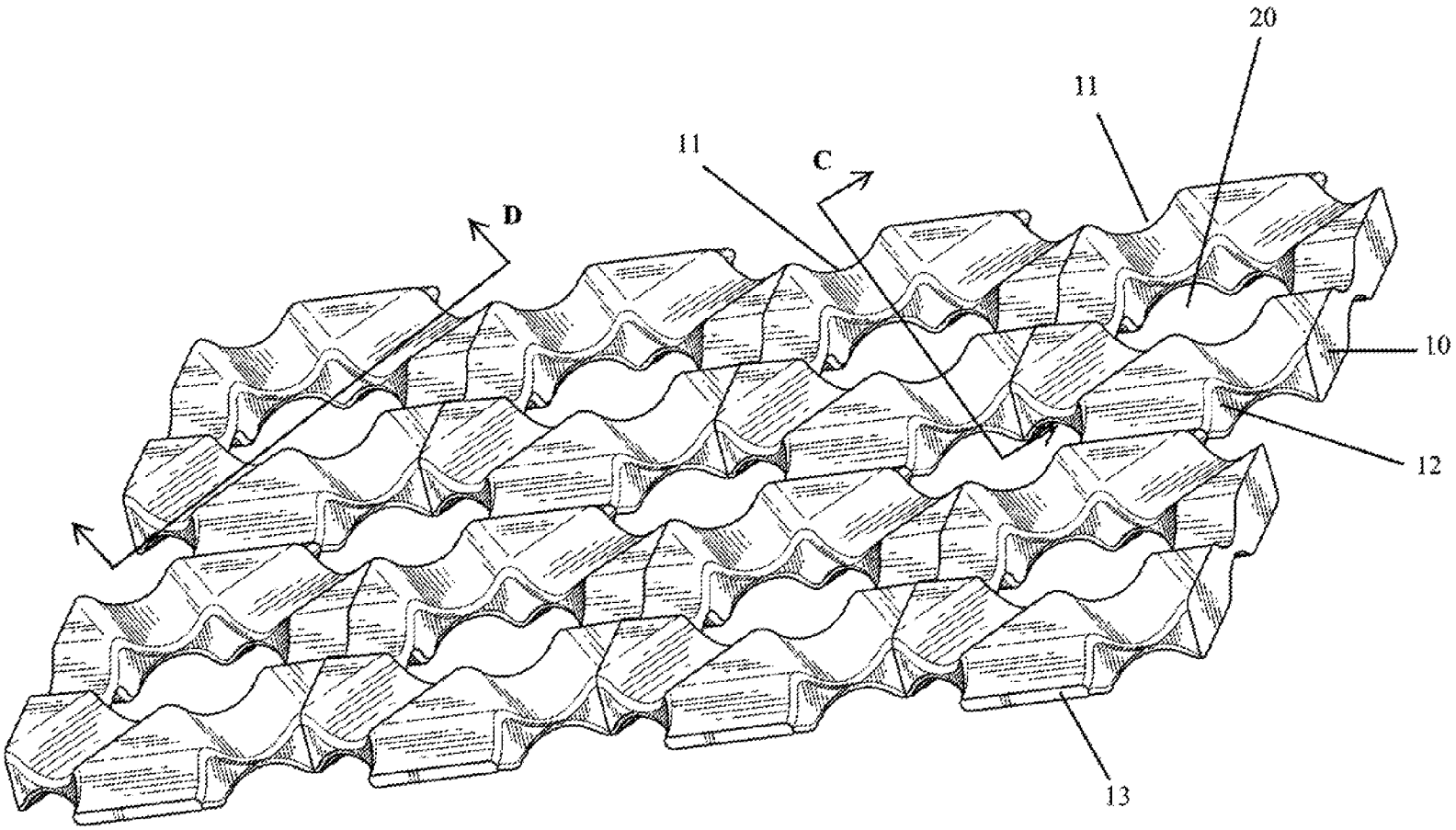
FIG. 5 illustrates a perspective view of the flexible padding layer according to the present invention from above.

FIG. 5 shows a plurality of elements 2 in perspective view, where the varying thickness of each element 2 can be seen relative to its lateral shape. Also as shown in FIGS. 1 and 5, a plurality of elements 2 are joined together along their lateral 10 and distal 13 edges to form flexible padding layer 1. Each element 2 shares two thick triangular sections 5 and one shoulder 6 with each adjoining element 2, and the thick triangular sections 5 between adjoining elements 2 facilitate flexion along the vertical axes of shoulder 6, such that each element 2 is permitted a lateral degree of freedom to shift and flex upon impact with a ball or with another player or other piece of sports equipment. In direction A, as indicated in FIG. 1, flexible padding layer 1 is permitted to articulate due to the joint operation of the flex region formed between adjoining elements 2 and the space between adjoining elements 2 left due to opening 20. Flexibility in direction B, as indicated in FIG. 1, is permitted through the dual operation of the flex region between lateral edges 10 and the space between adjoining elements 2 left due to opening 20. Additionally, flexibility in directions C and D as denoted in FIG. 5 is enhanced through the slimmed profile formed diagonally along a grouping of elements 2 perpendicular to shoulders 11.

In addition, the spacing, multi-axis orientation, and shape of flexible padding layer 1 combine to ensure uniform material properties such as strength, density, elasticity, etc. in any direction. Unlike prior art padding, which has similar properties in only a few directions, flexible padding layer 1 is isotropic in that all of its physical properties are essentially uniform in all directions. Unlike the prior art, this allows flexible padding layer 1 to evenly distribute the forces associated with an impact from a ball or other element, while flexibly conforming to the shape and movement of a player's body and resisting tearing or cracking.

The entire flexible padding layer 1 may be formed as a unitary piece by injection or compression molding. The total number of elements 2 included within flexible padding layer 1 may be determined based on the overall surface area of the desired pad, and/or on the shape and size of the portion of a player's body needed to be covered by flexible padding layer 1. As can be seen, flexible padding layer 1 is flexible enough to conform to nearly any area of a player's body and to flex with the natural movement of the player's body. In addition, elements 2 may be cut, or partially formed, at edges not corresponding to the natural edges of same in order to allow flexible padding layer 1 to achieve any desired lateral shape, such as a trapezoidal shape to cover all or part of a player's chest. In addition, opposite edges of flexible padding layer 1 may be joined to form a sleeve or other tubular article capable of being worn around a player's arm or leg, and/or various edges of flexible padding layer 1 may be provided with fastening means and/or openings, such as for arm or neck holes, to permit flexible padding layer 1 to be placed on a player's body.

To adapt flexible padding layer 1 into an article capable of being worn by a player during game play, flexible padding layer 1 may be provided with fastening means along its outer edges or on one or both of its faces to allow it to be securely fastened around a player's body and/or to other padding or garments being worn by the player during the game. In addition, flexible padding layer 1 may be attached at its exterior edges to an elastic fabric material to permit flexible padding layer 1 to be incorporated into a larger element of padding or clothing to be worn by a player. Alternatively, flexible padding layer 1 may be sandwiched between two layers of elastic, fabric, or other conformable material to strengthen a garment being worn by a player.

Having, now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A flexible padding layer, comprising a section of resilient sheet material, having an upper surface and an opposing lower surface, said sheet material formed with repetitive composite pattern of surface features, said repetitive composite pattern comprising a geometric array of a plurality of structural elements, at least one structural element of each surface feature being shared with an adjoining surface feature, each surface feature further comprising:

a polygonal perforation surrounded by a plurality of sides joined at corners; and a contoured crown surrounding said polygonal perforation, said crown including at each said corner an angular section having a first surface forming said upper surface, said angular sections being separated by a plurality of shoulders extending along said sides, said plurality of shoulders each integrally joining a pair of said plurality of angular sections to form said crown, wherein each shoulder tapers from said first surface between adjoining angular sections in an arc-shaped concavity; and wherein said surface patterns and perforations collectively providing consistent flexibility in multiple directions.

2. The flexible padding layer according to claim 1, wherein said angular sections have an opposing second surface forming said lower surface, wherein each shoulder tapers from said second surface at said opposing edges such that an opposing cross-section adjoining angular sections is also an arc-shaped concavity.

3. The flexible padding layer according to claim 2, wherein each shoulder tapers to a first thickness, and said plurality of angular sections are of a greater thickness between said first and second surfaces than said first thickness.

4. The flexible padding layer according claim 3, wherein said greater thickness is a uniform thickness.

5. The flexible padding layer according to claim 1, wherein the arc-shaped concavity is symmetrical.

6. The flexible padding layer according to claim 1, wherein said shoulders extend along the entirety of said sides.

7. The flexible padding layer according to claim 1, wherein said polygonal perforation is hexagonal.

8. The flexible padding layer according to claim 7, further comprising six radially-arrayed shoulders.

9. The flexible padding layer according to claim 8, wherein said angular sections are triangular.

10. The flexible padding layer according to claim 9, further comprising six triangular angular sections.

11. The flexible padding layer according to claim 1, wherein each said structural element overlaps an adjacent structural element by sharing at least one shoulder.

12. The flexible padding layer according to claim 11, wherein each said structural element overlaps an adjacent structural element by sharing one shoulder and two angular sections.

13. A flexible padding layer, comprising:

a resilient sheet material, having an upper surface and an opposing lower surface, said sheet material defined by a composite pattern of surface features, said composite pattern comprising a repeating array of structural elements, each said structural element in said array comprising, a geometric perforation through said sheet material, a plurality of polygonal sections radially arrayed around said geometric perforation, said polygonal sections having a first surface forming said upper surface, each polygonal section having a plurality of sides connected by vertices, a plurality of shoulders integrally attached to each of said polygonal section sides, wherein each shoulder extends between a pair of opposing sides and are tapered at said opposing sides from said first surface such that a cross-section between opposing sides is an arc-shaped concavity, wherein said array of surface features collectively provides consistent flexibility in multiple directions.

14. The flexible padding layer according to claim 13, wherein said polygonal sections have an opposing second surface forming said lower surface, wherein each shoulder tapers from said second surface at said opposing edges such that an opposing cross-section between opposing edges is also an arc-shaped concavity.

15. The flexible padding layer according to claim 14, wherein each shoulder tapers to a first thickness, and said plurality of polygonal sections are of a greater thickness between said first and second surfaces than said first thickness.

16. The flexible padding layer according claim 15, wherein said greater thickness is a uniform thickness.

17. The flexible padding layer according to claim 13, wherein the arc-shaped concavity is symmetrical.

18. The flexible padding layer according to claim 13, wherein each of said shoulders abuts a side of said geometric perforation, wherein said geometric perforation is a polygon surrounded by a plurality of sides joined at corners.

19. The flexible padding layer according to claim 18, wherein said polygonal perforation is hexagonal.

20. The flexible padding layer according to claim 19, further comprising six radially-arrayed shoulders.

21. The flexible padding layer according to claim 20, wherein said polygonal sections are triangular.

22. The flexible padding layer according claim 21, further comprising six triangular sections.

23. The flexible padding layer according to claim 18, wherein each said structural element overlaps an adjacent structural element.

24. The flexible padding layer according to claim 23, wherein each said structural element overlaps an adjacent structural element by sharing at least one shoulder.

25. The flexible padding layer according claim 24, wherein each said element overlaps an adjacent structural element by sharing at least one polygonal section.

26. The flexible padding layer according claim 25, wherein each said element overlaps an adjacent structural element by sharing one shoulder and two polygonal sections.

* * * * *